United States Patent [19]

Ingels

[11] Patent Number: 4,807,311

[45] Date of Patent: Feb. 28, 1989

[54] BIDET ATTACHMENT FOR CONVENTIONAL COMMODES

[76] Inventor: Luis Ingels, 242 S. Irwindale, Azusa, Calif. 91702

[21] Appl. No.: 68,565

[22] Filed: Jun. 30, 1987

[51] Int. Cl.[4] ..... A47K 3/20; A47K 3/22

[52] U.S. Cl. ..... 4/443; 4/420.4; 4/447; 4/448

[58] Field of Search ..... 4/443, 448, 447, 445, 4/420.4, 420.1, 420.2, 420.3, 423; 137/384.6, 384.8

[56] References Cited

U.S. PATENT DOCUMENTS

| | | | |
|---|---|---|---|
| 1,887,679 | 11/1932 | Guidetti et al. | 4/420.2 |
| 2,004,455 | 6/1935 | Woolley | 4/423 |
| 2,344,561 | 3/1944 | Popil | 4/420.2 |
| 2,394,911 | 2/1946 | Griswold | 4/423 X |
| 3,311,929 | 4/1967 | O'Brien | 4/423 |
| 3,829,905 | 8/1974 | Broek | 4/423 |
| 4,068,325 | 1/1978 | Benthin | 4/420.4 |
| 4,340,039 | 7/1982 | Hibbard et al. | 4/542 X |
| 4,340,980 | 7/1982 | Fushimi et al. | 4/420.4 X |
| 4,391,004 | 7/1983 | Kawai et al. | 4/420.4 X |
| 4,411,030 | 10/1983 | Kawai et al. | 4/420.4 X |
| 4,637,080 | 1/1987 | Hutchinson | 4/544 X |

*Primary Examiner*—Henry K. Artis

*Attorney, Agent, or Firm*—Donald D. Mon; David O'Reilly

[57] ABSTRACT

A bidet attachment for conventional commodes which have a bowl. The attachment has a swing arm with a spray head that can be moved toward and away from the center of the bowl. The arm is mounted by a swivel mount. The swivel mount includes anti-siphon means, and a safety valve. The safety valve closes the system unless the swing arm is in place, thus making safe the use of a swing arm which can readily be removed for cleaning or storage.

7 Claims, 2 Drawing Sheets

10
11
12
13
14
15
16
17
18
20
21
22
25
26
27
28
29
55
61
110
2
2

11
25
26
28
35
36
55b
3
3

BIDET ATTACHMENT FOR CONVENTIONAL COMMODES

FIELD OF THE INVENTION

This invention relates to bidets, and especially to an attachment to provide a bidet function for a conventional commode.

BACKGROUND OF THE INVENTION

Bidets are widely known in countries foreign to the United States, and are recognized and used by an increasing number of persons in the United States. Still, bathrooms and rest rooms in the United States are not generally equipped with this function. Instead, they are provided with a conventional sit-down commode not equipped as a bidet, and there is no space left in the room for a separate bidet. It is an object of this invention to provide an attachment for a conventional commode that does not require the dedication of the commode to the bidet function, and which when installed is out-of-the-way and unobtrusive.

Attachments for this purpose have previously been proposed. The most pertinent provides a spray arm which can swing from a stored, out-of-the-way location to an active location centrally in the cavity of the commode. These have not enjoyed any substantial acceptance known to the instant inventor, and the recognized advantages of the use of a bidet have therefore not heretofore been available except from plumbing installations dedicated to that function.

It is postulated that the known devices have been unable to provide these advantages for several reasons. First, plumbing and sanitary codes have severe restrictions which are most difficult to meet in the limited space where the bidet parts must be placed. Second, the spray arms were in the commode at all times, and often the owner would prefer not to have it so. Third, if the spray arm were removable, the risk would arise of an improperly directed stream of water which could flood or spatter the room. As a consequence of these and other problems, the attached bidet has failed of acceptance.

It is another object of this invention to overcome the above disadvantages by providing code-acceptability, especially as to siphon-breaking capacity, and to enable the spray arm to be removed and stored separately, while safetying the system against inadvertent water flow unless the spray arm is properly installed.

BRIEF DESCRIPTION OF THE INVENTION

A bidet attachment according to this invention includes a body adapted to be attached to the commode. Most conveniently a supporting bracket will be mounted to the commode where the conventional toilet seat hinges are also attached. The body stands to the side of the rim, out of the way of a person seated on the commode. A spray arm is pivotally mounted to the body and extends over the rim and into the commode cavity. It can be pivoted into the center of the opening for use, and can be pivoted to one side where it can fit closely to, or even partly under the rim. Selector valves for hot water and for cold water, adjustable so as to select the water temperature, discharge to an off-on control valve that discharges to the spray arm. These are known features in this art.

According to a feature of this invention, the control valve discharges to the swing arm through a siphon breaker of the nozzle type which aspirates air into the stream flow. Should the upstream conduit experience a negative pressure, air will be drawn into the siphon breaker to prevent backflow of liquid from the swing arm into the upstream system.

According to yet another feature of the invention, the swing arm is detachable from the body, but there is also a safety valve which is opened by the swing arm when present, and which closes the attachment to flow when the swing arm is removed. Bracket means is provided to store the swing arm when it is removed.

According to a preferred but optional feature of the invention, a removable spray tip is fitted to the free end of the spray arm, so it can be removed, washed, and replaced.

The foregoing features enable this attachment to meet very stringent code and plumbing laboratory requirements, so as to be eligible for sale in areas under their control. In addition, it is unobtrusive, and can be made even more unobtrusive by removing and storing the spray arm when not in use, and be safetied against inadvertent discharge of water. It is an agreeable and convenient attachment.

The above and other features of this invention will be fully understood from the following detailed description and the accompanying drawings, in which:

DETAILED DESCRIPTION OF THE DRAWINGS

Figure 1:
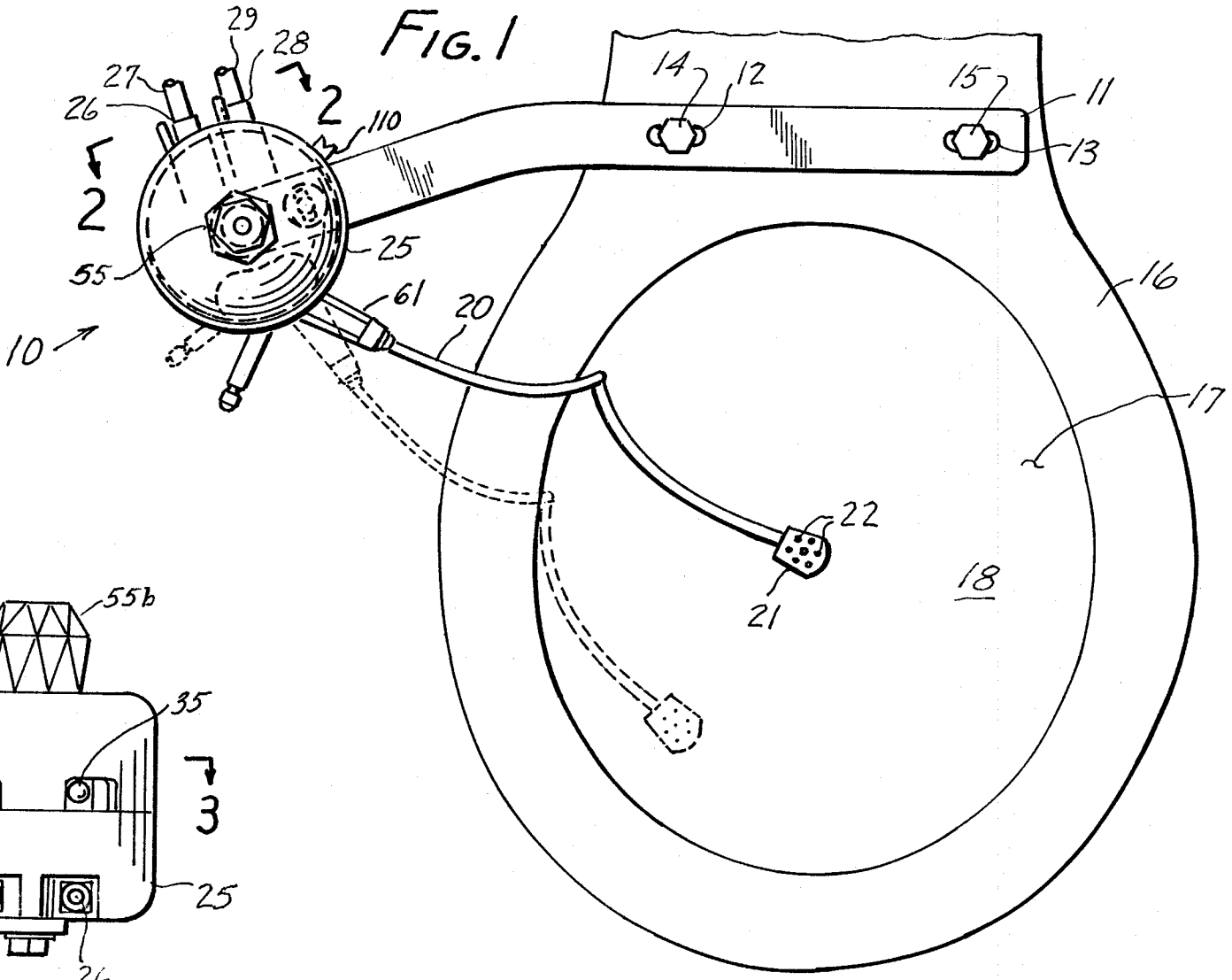
FIG. 1 is a plan view of the presently-preferred embodiment of the invention.
Figure 2:
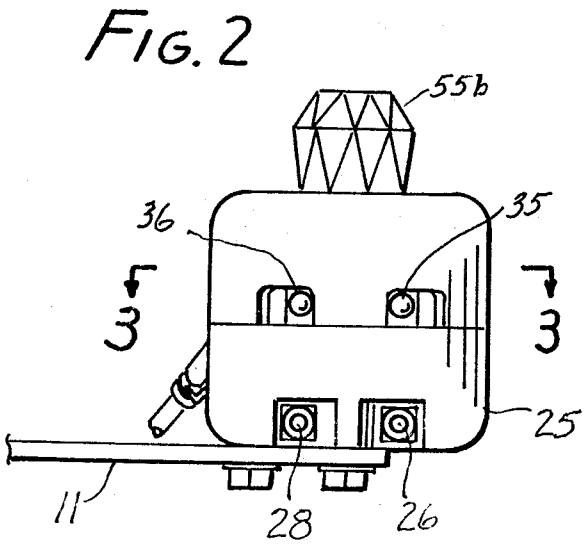
FIG. 2 is a cross-section taken at line 2—2 in FIG. 1.

FIG. 1 shows a bidet attachment 10 according to the invention. It includes a mounting bracket 11 with holes 12, 13 spaced and shaped to accept hinge posts 14, 15 of a conventional toilet seat (not shown). The commode includes a rim 16 and a bowl 17 forming a cavity 18 beneath the rim and inside the bowl. The toilet seat will customarily carry spacers on its bottom surface to form a clearance between the seat and the rim to pass spray arm 20 of this attachment. Spray arm 20 is sometimes called a "swing arm". The spacers will be placed far enough apart to enable the spray arm to swing from a central position shown in solid line to a stored position shown in dashed line in FIG. 1. The spray arm is a hollow tube, and will be bent to a shape where it most closely approaches the rim and bowl wall when out of use. In the central position, its spray head 21 will ordinarily be about two inches below the top of the rim, and about six inches above the water level in the commode. Its level is above any predictably attainable height of water in the commode at any time or circumstance. Its location can be adjusted by appropriately bending the spray arm.

The spray head has a pattern of discharge ports 22 to discharge a desired pattern of water. It is conveniently made of plastic for easy cleaning and inexpensive replacement. It forms a slip fit on the spray arm, fluid tight, and strong enough to resist being blown off by the applied water pressure. It may be keyed against rotation around the tube so the spray ports are directed vertically, or may be rotatable if for some reason it is desirable to direct the spray in some other direction.

Figure 4:
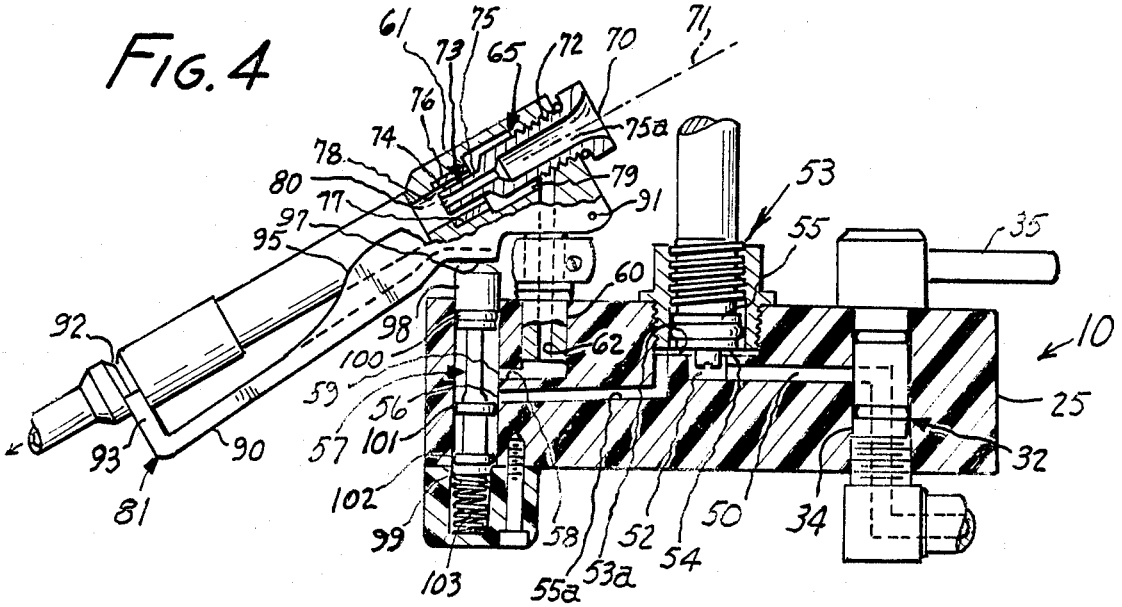
FIG. 4 is a cross-section taken at line 4—4 in FIG. 3.

The attachment includes a body 25 fixed to the mounting bracket. Hot water inlet port 26 is connectible to a system hot water line 27. Cold water inlet port 28 is connectible to a system cold water line 29. Inlet conduits 30, 31 lead from ports 26 and 28 to hot water selector valve 32 and cold water selector valve 33, respectively. Valves 32 and 33 are rotatable- core valves whose cores (such as core 34 in valve 32, FIG. 4) adjust the rate of flow therethrough as a consequence of their rotary setting. Handles 35, 36 are provided to make this adjustment, and thereby the selection of the water temperature when the two flows are mixed. One rarely would want either entirely cold or entirely hot water. The temperature from a mixed supply is usually to be preferred.

Hot and cold water conduits 50, 51, respectively, discharge into mixing chamber 52 of control valve 53, where the water assumes the temperature determined by the temperature of the hot and cold water sources, and the amounts of each passed by the selector valves. Control valve 53 is a rotary plug valve with a seat 53*a*, and a seal 54 on a core 55. The core is threadedly mounted so that turning a knob 55*b* fixed to it adjusts the spacing between the seat and the seal and thereby establishes the rate of flow. When closed, it prevents flow to the swing arm. If desired, check valves (not shown) may be plumbed into the supply lines or conduits upstream from the mixing chamber to prevent backflow into one line of supply water from another which might cross-flow through the mixing chamber.

Conduit 55*a* exits the control valve and passes water to the inlet port 56 of a safety valve 57.

Conduit 58 interconnects outlet port 59 of the safety valve to a swivel joint 60. The swivel joint supports a swivel 61, and a conduit 62 passes upwardly through it to a siphon breaker 65 in the swivel.

This siphon breaker is considerably more sophisticated than it appears to be, and is the result of a diligent and long-sustained effort to create a reliable device which can withstand the peculiar and demanding conditions to which it is subjected.

The swivel has an air port 70 open at an upper end. Its axis 71 slopes downwardly from this port. Threads 72 receive an air injector nozzle 73 which has a tubular neck 74 with an outer cylindrical wall 75 and an open air passage 75*a* from end to end. A cylindrical insert 76 fits in a counter bore 77 in port 70. A peripheral clearance 78 is formed between wall 75 and the inside of the insert. This construction enables the clearance to be very closely established. Conduit 62 discharges into a peripheral chamber 79 in port 70, which in turn communicates with the clearance. Water that is passed by the control and safety valves flows to chamber 79, and from there is expelled at a considerable velocity in a ring shaped flow around and away from the nozzle parallel to its axis, flowing into discharge conduit 80 in the swivel. This flow acts in an aspirator fashion, to draw air into the water stream through the nozzle, producing a mixture of water and air. Because of its velocity and direction it does not tend to back up through the open nozzle tube. The swivel includes a fitting 81, detachably to receive and hold the swing arm. The water and air from the swivel then enter the tubular swing arm and flow to its tip and out to the user.

A handle 85 is mounted to the swivel to enable the user to rotate the swivel around its center so that the spray arm can be moved from one position to the other. The user then does not have to touch the swing arm itself.

Figure 3:
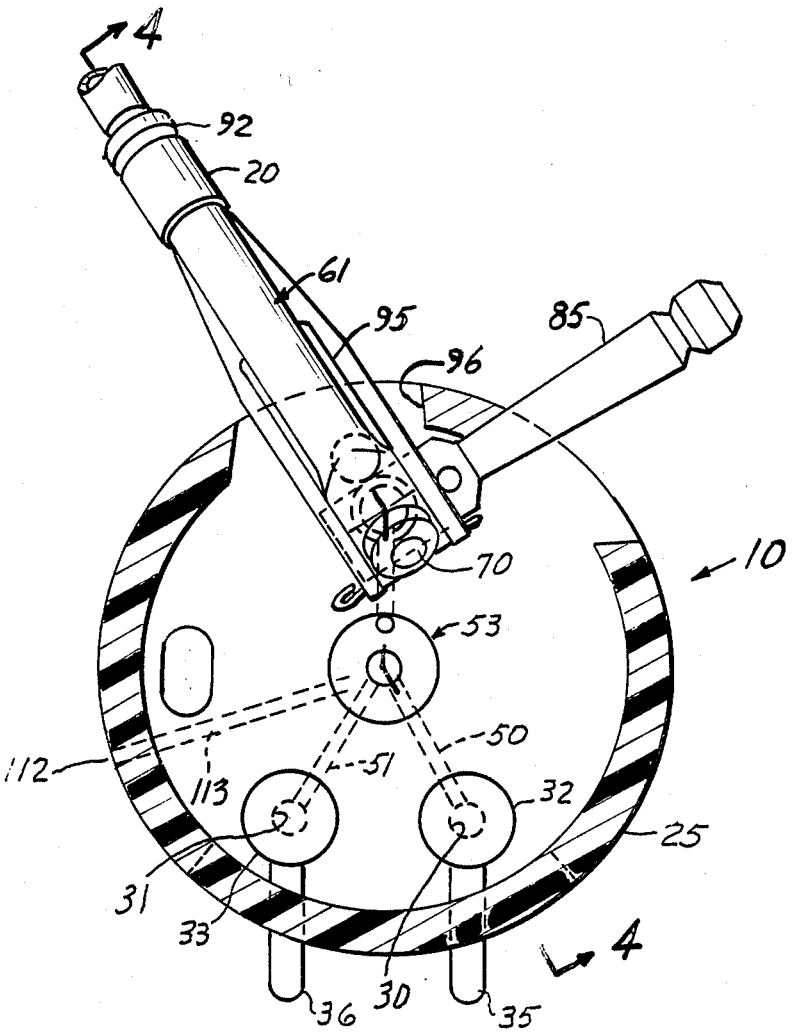
FIG. 3 is a cross-section taken at line 3—3 in FIG. 2.

Fitting 81 comprises a latch arm 90 pivotally mounted to the swivel by a hinge pin 91. The swing arm has a groove 92 positioned to receive a finger 93 on the latch arm. The latch arm has wings 95 to cradle with the swivel. The swivel is *not* tiltable in a vertical plane. It can only be rotated around a vertical axis. It passes through an aperture 96 in the body (FIG. 3) which limits its angular excursions. A contact pad 97 on latch arm 90 is wide enough to contact button 98 in all attainable positions, and the clearance between latch arm 90 and the swivel is sufficient for the safety function next to be described.

Safety valve 57 is a poppet type valve which includes a poppet 99 with axially spaced-apart seals 100, 101, and 102. A bias spring 103 biases the poppet upwardly in FIG. 4. When the swing arm is in place as shown, the finger engages the swing arm and the latch causes the pad to press down on the button, depressing the poppet and enabling flow between seals 100 and 101. If the swing arm is removed the finger will clear the end of the swivel. Then spring 103 presses the poppet and button against the pad, allowing the poppet to rise so that seals 101 and 102 straddle port 56, thereby closing the system. Thus the system will be closed to flow unless the swing arm is in place.

A bracket 110 is attached somewhere on the device to hold the swing arm when it is removed. The bracket has a pair of tangs that can fit into groove 92 on the swing arm to hold it. Groove 92 can also receive the finger on the latch arm to give additional retention to the spring arm.

Occasionally it may be desired to inject medication into the stream. An optional port 112 and conduit 113 are available for this purpose. An external pressure source, such as an elevated fluid supply or squeeze bulb can provide the differential pressure for this purpose.

This attachment thereby provides features which are attractive to users, and are essential to acceptance by regulatory authorities.

This invention is not to be limited by the embodiment shown in the drawings and described in the description, which is given by way of example and not of limitation, but only in accordance with the scope of the appended claims.

I claim:

1. A bidet attachment for conventional commodes having a bowl, said attachment including a body, an adjustable hot water valve and an adjustable cold water valve, adapted to receive and control the flow of a respective hot and cold water supply, said water valves discharging to a control valve adapted to mix the water passed by the two water valves and control the rate of flow of mixed water, including the capacity to shut it off, a tubular swing arm pivotally mounted to said body so as to swing from a position near the rim of the bowl to a position central in the bowl, there being a spray head on the end of the swing arm, and handle means for swinging the arm from one said position to the other, the improvement comprising:

swivel mounting means mounting said swing arm on said body, said swivel mounting means having a conduit to discharge water thereto, anti-siphon means comprising an internal passage on said swivel mounting means receiving water which has passed through said control valve, said internal passage having a cylindrical wall, a tubular nozzle having an air passage from end to end fitted in said swivel mounting means with an outer cylindrical wall coaxial with and at least partly coextensive with said internal passage, thus leaving an annular clearance for discharging water annularly and axially forward into said swing arm with said air passage open to discharge air therein, and to prevent backflow in the event of a negative supply pressure; said swing arm being removably fitted to said swivel mounting means, and in which a safety valve is interposed between the control valves and said anti-siphon means to close the attachment to flow unless said swing arm is fitted to the swivel mounting means.

2. An attachment according to claim 1 in which said safety valve comprises a poppet having an open-to-flow and a closed-to-flow position, with spring bias means biasing it towards its closed-to-flow position, and in which a latch arm is contacted by the swing arm when fitted to the swivel to assume a position that opposes the bias and moves the poppet to its open-to-flow position; removal of the swing arm enabling the bias means to move the latch arm and restore the poppet to its closed-to-flow position.

3. An attachment according to claim 2 in which said swing arm has a retention groove, and said latch arm has a finger adapted to enter said groove to assist in retention of the swing arm to the swivel.

4. An attachment according to claim 3 in which a bracket is fixed to the body to hold the swing arm when it is removed from the swivel.

5. A bidet attachment for conventional commodes having a bowl, said attachment including a body, an adjustable hot water valve and an adjustable cold water valve, adapted to receive and control the flow of a respective hot and cold water supply, said water valves discharging to a control valve adapted to mix the water passed by the two water valves and control the rate of flow of mixed water, including the capacity to shut it off, a tubular swing arm pivotally mounted to said body so as to swing from a position near the rim of the bowl to a position central in the bowl, there being a spray head on the end of the swing arm, and handle means for swinging the arm from one said position to the other, the improvement comprising:

a swivel mounting said swing arm to said body, said swivel having a conduit to discharge water thereto, said swing arm being removably fitted to said swivel, and in which a safety valve is interposed between the control valves and the swivel to close the attachment to flow unless said swing arm is fitted to the swivel; said safety valve comprising a poppet valve having open-to-flow and a closed-to-flow positions, with spring bias means biasing it toward its closed-to-flow position, and in which a latch arm is contacted by the swing arm when fitted to the swivel to assume a position that opposes the bias and moves the poppet to its open-to-flow position, removal of the swing arm enabling the bias means to move the latch arm and restore said poppet valve to its closed-to-flow position.

6. An attachment according to claim 5 in which said swing arm has a retention groove, and said latch arm has a finger adapted to enter said groove to assist in retention of the swing arm to the swivel.

7. An attachment according to claim 6 in which a bracket is fixed to the body to hold the swing arm when it is removed from the swivel.

* * * * *